US006453614B1

(12) United States Patent
Rogers, Jr. et al.

(10) Patent No.: US 6,453,614 B1
(45) Date of Patent: Sep. 24, 2002

(54) VEHICLE LIFTGATE POWER OPERATING SYSTEM

(75) Inventors: Lloyd Walker Rogers, Jr., Shelby Township; Howard Warren Kuhlman, Rochester Hills; Douglas Dombrowski, Troy, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/848,453

(22) Filed: May 3, 2001

(51) Int. Cl.[7] ..... E05F 11/24
(52) U.S. Cl. ..... 49/340; 296/56
(58) Field of Search ..... 49/339, 340, 341, 49/342; 296/56

(56) References Cited

U.S. PATENT DOCUMENTS 4,903,435 A 2/1990 Bittmann et al.
5,588,258 A 12/1996 Wright et al.
6,055,775 A * 5/2000 Dering et al. ..... 49/340
6,055,776 A * 5/2000 Dettling et al. ..... 49/341
6,092,337 A * 7/2000 Johnson et al. ..... 49/340
6,318,025 B1 * 11/2001 Sedlak ..... 49/341

* cited by examiner

*Primary Examiner*—Jerry Redman
(74) *Attorney, Agent, or Firm*—Kathryn A. Marra

(57) ABSTRACT

A power operating system for opening and closing a vehicle liftgate has a pair of drive units supported on the respective vehicle pillars at the sides of the liftgate opening. Each drive unit includes a vertically oriented channel and a rack member that moves in the channel. The rack member comprises a rack bar and a plurality of rack links that are pivotally connected end-to-end. A transfer link is universally attached to the rack bar at one end and universally attached to the liftgate at the opposite end. The rack member is raised and lowered by a power unit that has a motor driven pinion gear that meshes with teeth of the rack bar and the rack links in succession. Raising and lowering the rack member opens and closes the liftgate via the transfer link.

14 Claims, 1 Drawing Sheet

VEHICLE LIFTGATE POWER OPERATING SYSTEM

TECHNICAL FIELD

This invention relates to a power operating system for a vehicle liftgate that is pivotally attached to a vehicle roof for pivotal movement about a generally horizontal hinge axis and more particularly to a power operating system that moves a liftgate from a fully closed position to a fully open position and from an open position to a fully closed position.

BACKGROUND OF THE INVENTION

Sport utility vehicles, vans and the like that are equipped with liftgates that are hinged at the top about a generally horizontal hinge axis are used by large numbers of people today. Some of these liftgates are large and heavy. Their size and weight make some liftgates difficult to open and close. Some of the liftgates are also a great distance above the ground when they are fully opened. Their height above the ground makes them very difficult for some people to close. For these and other reasons many people would like to have a power operating system for opening and closing the liftgate.

A number of different liftgate openers have been tried in recent years. Some of these liftgate openers have a single cable that opens and closes a liftgate in connection with a counterbalance system, such as gas cylinders. Liftgates with a single cable opener and closer are generally trunk lids that are lightweight and have a relatively small range of movement.

Gas cylinder output varies with temperature. This complicates power liftgate systems that rely on gas cylinders to open the liftgate. The gas cylinder or cylinders must be strong enough to open the liftgate on the coldest date (−40° C.). This results in gas cylinders that increase closing resistance substantially on the hottest day (80° C.). Therefore a very large electric motor must be used to close the liftgate.

Liftgates that have two or more gas cylinders for a counter balance system are common. These gas cylinders generally occupy a position in which their axis is substantially parallel to the liftgate so that the gas cylinders are hidden when the liftgate is closed. In this closed position the moment arm of the gas cylinders is quite small. With such systems the lift gate may move about one-third of their total travel range before the gas cylinders exert sufficient force to open a liftgate further without the application of an independent lifting force. There are even some systems in which the gas cylinders pass over center and bias a liftgate toward a closed position when the liftgate is closed. With these self-closing systems a liftgate may need to be more than one-third open before the gas cylinders will open the liftgate further.

U.S. Pat. No. 4,903,435 granted to Werner Bittmann et al Feb. 27, 1990 discloses a device for motorized opening and closing of pivotal body panels of motor vehicles comprising an actuation rod that is pivotally attached to the pivotal body panel at one end and to a slide block at the opposite end. The slide block is moved in an inclined linear track by a control cable that is moved in a closed loop by a cable drum driven by an electric motor. The Bittmann '435 device is bulky and cumbersome and relies on gravity to fully close the pivotal body panel.

U.S. Pat. No. 5,588,258 granted to Kevin Wright et al Dec. 31, 1996 discloses a power operator for a pivotal closure element comprising two gas charged struts and an extendible strut adapted for extension by a cable drive. This power operation opens and closes the pivotal closure element fully. However, the extendible strut and cable drive are complicated and expensive and require substantial vertical space.

U.S. Pat. No. 6,055,775 granted to Timothy Dering et al May 2, 2000 discloses a liftgate self-closing device comprising a pneumatic actuator that is pivotally attached to liftgate at one end and to a tape at the opposite end. The tape is a generally elongated belt member having a rack formed on an underside. The rack is disposed in a track and driven by a pinion gear attached to the output shaft of an electric motor. Alternatively, tape could be an endless member. In either event, the liftgate is opened manually until an over center condition is achieved in the pneumatic actuator which then opens the liftgate automatically. The liftgate is closed by energizing the motor to drive the tape and pneumatic actuator downwardly until the liftgate is closed by gravity. The Dering device requires manual operation to open the liftgate and relies on gravity to fully close the liftgate.

U.S. Pat. No. 6,092,337 granted to Joseph Michael Johnson et at Jul. 25, 2000 discloses a vehicle liftgate power operating system having two drive units in which a segmented sector rides in a track with an end sector that is attached to the liftgate. The segmented sector is driven by a pinion gear attached to the output shaft of an electric motor. This power operating system opens and closes the liftgate fully and is satisfactory for its intended purpose. However, the drive units reduce the head room in the cargo space which may be objectionable to some users.

SUMMARY OF THE INVENTION

The object of the invention is to provide an improved vehicle liftgate power operating system.

A feature of the invention is that the vehicle liftgate power operating system can move the liftgate from a closed position to a fully opened position as well as from an open position to a fully closed position.

Another feature of the invention is that the liftgate power operating system does not diminish head room in the cargo area.

Another feature of the invention is that power operating system is compact durable and economical to manufacture.

Still another feature of the invention is that the drive unit of the liftgate power operating system has fewer parts and is less complicated than other power operating systems.

Yet another feature of the invention is that the liftgate power operating system is vertically oriented and associated with the D-pillar to minimize intrusion into the cargo area of the vehicle and into the unobstructed load width at the liftgate opening.

Still yet another feature of the invention is that the vertically oriented, liftgate power operating system uses a flexible drive member in a track that can be curved to get around obstacles associated with the D-pillar.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 2:
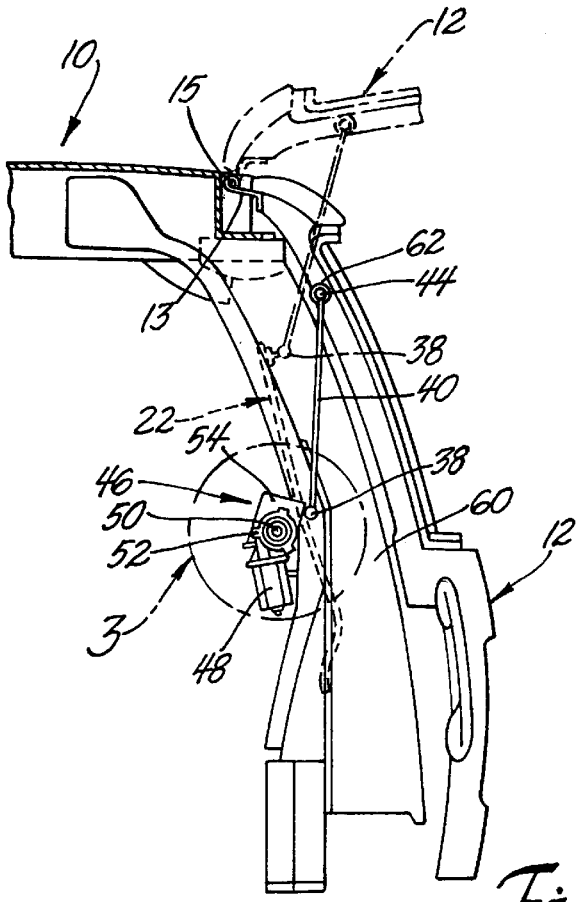
FIG. 2 is a section taken along the line 2—2 of FIG. 1 looking in the direction of the arrows.
Figure 1:
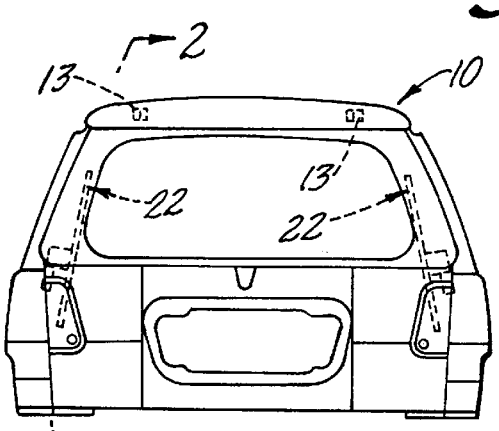
FIG. 1 is a rear view of a of a sport utility vehicle equipped with a liftgate power operating system of the invention.

Sport utility vehicle 10 has a liftgate 12 that is attached to the aft end of the vehicle roof by two hinge assemblies 13 so that liftgate 12 pivots about a generally horizontal hinge 15 axis from a closed position shown in FIGS. 1, 2 (solid line) and 3 to a raised open position shown in dashed line in FIG. 2. Hinge axis 15 is generally substantially horizontal and liftgate 12 is generally permitted to pivot about 90° about the pivot axis between a generally horizontal open position and a generally vertical closed position. However, the range of movement can be varied substantially from one model of vehicle to another.

Liftgate 12 is opened and closed by a power operating system that includes at least one and preferably two identical lift mechanisms 22 that are installed in the aft end of the vehicle at the respective D-pillars that define the width of the rear opening to the cargo area that is closed by liftgate 12. One typical lift mechanism 22 is shown in detail in FIG. 3.

Figure 3:
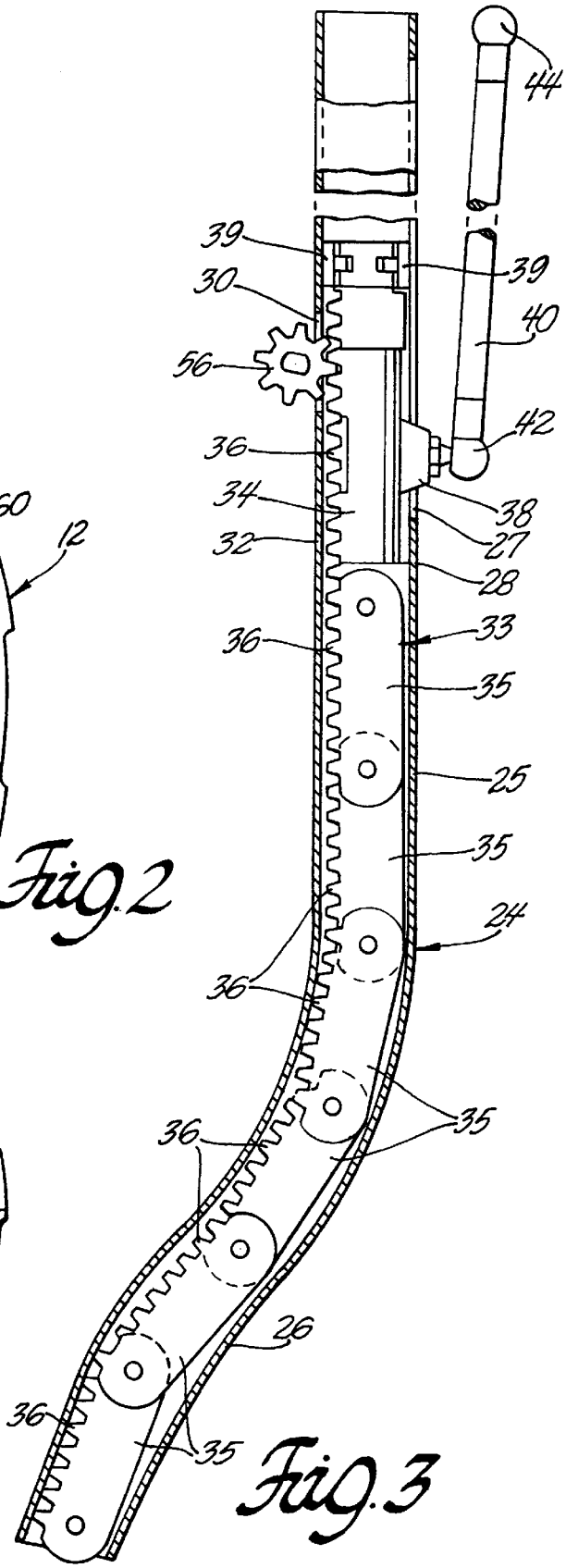
FIG. 3 is an enlargement of the circled portion 3 of FIG. 2.

Lift mechanism 22 comprises an annular, square shaped channel 24 having a linear upper portion 25 and a curved lower portion 26. Channel 24 has a longitudinal slot 27 in the linear upper portion of side wall 28 and a window 30 in the linear upper portion of opposite side wall 32 that is aligned with the bottom portion of slot 27 as best shown in FIG. 3. A flexible drive member 33 is disposed in channel 24 for movement in the channel 24 which serves as a guide or track for the flexible drive member 33. The flexible drive member 33 is of the type that obtains flexibility by being made from small rigid parts that are joined in such a manner as to permit relative motion of the parts. The flexible drive member 33 that is illustrated comprises a linear rack bar 34 and a plurality of rack links 35 connected to the lower end of rack bar 34. The rack links 35 are pivotally connected end-to-end to form a chain that is pivotally connected to rack bar 34. Rack bar 34 and rack links 35 each have teeth 36 on one side facing side wall 32 so that window 30 provides access to teeth 36. A ball stud 38 is attached to the opposite side of rack bar 34 so that ball stud 38 extends through slot 27. Rack bar 34 preferably has shoes 39 of low friction material at the leading end to facilitate sliding movement of rack bar 34 in the linear upper portion 25 of channel 24.

Lift mechanism 22 includes a transfer link 40 that has a ball socket 42 at the lower end and a ball socket 44 at the upper end. Ball stud 38 is disposed in ball socket 42 so that the lower end of transfer link 40 is universally attached to rack bar 34. The opening of ball socket 44 is perpendicular to the opening of ball socket 42. Ball socket 44 is used to attach the upper end of transfer link 40 to liftgate 12 for universal movement relative to the liftgate 12 by means of a ball stud that is generally perpendicular to ball stud 38 as further explained below.

Lift mechanism 22 includes a power unit 46 for raising and lowering flexible drive member 33 in channel 24. Power unit 46 comprises an electric motor 48, a first gear set 50, an electromagnetic clutch 52 and a second gear set 54, that includes an output pinion gear 56. Electric motor 48 has a worm gear output that drives gear set 50 which changes the drive axis 90° and includes an output pinion gear that drives the input side of electromagnetic clutch; the output side of which drives gear set 54 which as indicated above has an output pinion gear 56. Power unit 46 is attached to a side wall of channel 24 so that pinion gear 56 projects into window 30 and meshes with teeth 36 of rack bar 34 when the liftgate 12 is closed as best shown in FIG. 3.

Lift mechanism 22 is installed in vehicle 10 with channel 24 fixed to the vehicle at the D-pillar 60 by suitable brackets, fasteners, weldments or the like (not shown). The channel 24 is supported in a generally vertical orientation with the linear upper portion 25 preferably as vertical as possible in both the longitudinal direction and the transverse direction of the vehicle while the curved lower portion 26 is oriented to minimize the protrusion of channel 24 into the cargo compartment particularly in the longitudinal direction of the vehicle.

Lift mechanism 22 is also installed so that the ball stud 38 faces rearwardly on an axis that is substantially parallel to the longitudinal axis of the vehicle. Teeth 36 are on the opposite side of the square rack bar 34 and rack links 35 and face forwardly. Power unit 46 is attached to the outboard side of channel 24.

The lower end of transfer link 40 is universally attached to the forward facing ball stud 38 at the by ball socket 42 which is open in the longitudinal direction. The upper end of link 40 is universally attached to a ball stud 62 at a side edge of liftgate 12 by upper ball socket 44 which is open in the transverse direction. Ball stud 62 is attached to a side edge of the lift gate 12 so that the axis of ball stud 62 is spaced from hinge axis 15 and essentially perpendicular to the longitudinal axis of the vehicle or a longitudinal axis parallel to it. Thus transfer link 40 is free to pivot in any direction with respect to rack bar 34 and with respect to liftgate 12. This freedom of movement reduces side loads on ball stud 38 that tend to twist rack bar 34 so that the substantially twist-free rack bar 34 slides in channel 24 smoothly and does not bind with the channel 24 or pinion gear 56. This freedom of movement also prevents rack links 35 from being twisted and binding with channel 24 or pinion gear 56.

The power operating system further includes a conventional power source such as the vehicle battery (not shown) and a suitable motor control for energizing and shutting off the reversible electric motor 48. Motor controls are well known to those skilled in the art and thus need not be described in detail.

The power operating system operates as follows. Assuming that the liftgate 12 is closed as shown in FIG. 1, in solid line in FIG. 2 and in FIG. 3, electric motor 48 and electromagnetic clutch 52 are energized to open liftgate 12. When energized, electric motor 48 rotates output pinion gear 56 counterclockwise via gear set 50, the engaged electromagnetic clutch 52 and gear set 54 This drives rack bar 34 and then the plurality of rack segments 35 in succession until ball stud 38 is driven from the retracted position shown in solid line in FIG. 2 to the raised position shown in dashed line in FIG. 2. This raises liftgate 12 from the closed position shown in solid line in FIG. 2 to the raised open position shown in dashed line in FIG. 2 via link 40. When the liftgate 12 is fully opened, a limit switch or the like is actuated to shut off electric motor 48. Electromagnetic clutch 52 may be maintained engaged to hold the liftgate 12 in the open position or a counterbalance system can be used. Liftgate 12 is closed by reversing electric motor 48 so that gear 56 drives rack member 33 back to the retracted position shown in FIG. 3.

The liftgate 12 can be moved manually in the event of a power failure easily because the deenergized clutch 52 allows the clutch output gear to free wheel with respect to electric motor 48 and gear set 50.

The power operating system can be designed to work alone or in conjunction with a counterbalance system employing gas cylinders which are well known in the art with the primary adjustment being the size of the electric motor 48.

The power operating system described above preferably includes two identical drive units 22 for balanced operation and reduced manufacturing costs. However, the drive units need not be identical and in some instances, a single drive unit may be sufficient.

While the preferred embodiment includes an electromagnetic clutch, it is possible to eliminate the electromagnetic clutch and use a back driveable electric motor to lower the cost. It is also possible to use other flexible drive members of the type disclosed, for example, a roller chain in which case gear 56 would be replaced with a sprocket. Moreover, the vertical channel 24 can be curved and oriented in any direction to avoid obstacles in the vicinity of the D-pillar. In other words, many modifications and variations of the present invention in light of the above teachings may be made. It is, therefore, to be understood that, within the scope of the appended claims, the invention may be practiced otherwise than as specifically described.

We claim:

1. A power operating system for opening and closing a vehicle liftgate that is pivotally attached to an aft end of a vehicle roof for pivotal movement between an open position and a closed position about a generally horizontal hinge axis comprising:

an annular channel having a linear upper portion and a curved lower portion, the linear upper portion having a longitudinal slot in a side wall of the annular channel and a window in the side wall of the annular channel disposed opposite the longitudinal slot, a rack member disposed in the channel for movement in the channel, the rack member comprising a rack bar and a plurality of rack links that are pivotally connected end to end to form a chain that is pivotally connected to the rack bar, the rack bar having a stud that extends through the longitudinal slot in the side wall of the annular channel, the rack bar and the plurality of rack links having teeth facing the window in the side wall of the annular channel, a transfer link having an end that is universally connected to the stud, the transfer link having an opposite end that is universally attached to the liftgate at a location spaced from the hinge axis, and a power unit having an output pinion gear meshing with teeth of the rack bar and the plurality of rack links in succession for moving the rack member in the annular channel between a first position holding the vehicle liftgate in the open position and a second position holding the vehicle liftgate in the closed position.

2. The power operating system as defined in claim 1 wherein the power unit is secured to the annular channel and comprises an electric motor that drives the output pinion gear via an electromagnetic clutch.

3. The power operating system as defined in claim 1 wherein the linear upper portion of the annular channel is disposed in the vehicle in a vertical orientation.

4. A vehicle having a vehicle liftgate that is pivotally attached to an aft end of a vehicle roof for pivotal movement between an open position and a closed position about a generally horizontal hinge axis and a power operating system for opening and closing the vehicle liftgate, the power operating system comprising:

a rectangular channel fixed to the vehicle at a pillar of the vehicle in a vertical orientation, the rectangular channel having a linear upper portion and a curved lower portion, the linear upper portion having a longitudinal slot in a side wall of the rectangular channel and a window in an opposite side wall of the rectangular channel, rack member disposed in the channel for movement in the channel, the rack member comprising a rack bar and a plurality of rack links that are pivotally connected end to end to form a chain that is pivotally connected to the rack bar, the rack bar having a stud that extends through the longitudinal slot in the side wall of the channel, the rack bar and the plurality of rack links having teeth facing the window in the opposite side wall of the channel, a transfer link having an end that is universally connected to the stud, the transfer link having an opposite end that is universally attached to the liftgate at a location spaced from the hinge axis, a power unit having an output pinion gear meshing with teeth of the rack bar for moving the rack bar in the channel between a first position holding the vehicle liftgate in the open position and a second position holding the vehicle liftgate in the closed position.

5. The power operating system as defined in claim 4 wherein the power unit is secured to the an outboard side wall of the channel and comprises an electric motor that drives the output gear via an electromagnetic clutch.

6. A vehicle having a vehicle liftgate that is pivotally attached to an aft end of a vehicle roof for pivotal movement between an open position and a closed position about a generally horizontal hinge axis and a power operating system for opening and closing the vehicle liftgate, the power operating system comprising:

a rectangular channel having a linear upper portion and a curved lower portion, the linear upper portion having a longitudinal slot in a side wall of the rectangular channel that faces rearwardly toward the liftgate, the rectangular channel having a window in an opposite side wall of the rectangular channel that faces forwardly away from the liftgate, a rack member disposed in the channel for movement in the channel, the rack member comprising a rack bar and a plurality of rack links that are pivotally connected end to end to form a chain that is pivotally connected to the rack bar, the rack bar having a stud that extends through the longitudinal slot in the side wall of the channel, the rack bar and the plurality of rack links having teeth facing the window in the opposite side wall of the channel, a transfer link having a first socket at one end that is universally connected to the stud, the transfer link having a second socket at an opposite end that is universally attached to a second stud attached to the liftgate at a location spaced from the hinge axis, a power unit having an output pinion gear that projects into the window of the channel and meshes with the teeth of the rack bar for moving the rack bar in the rectangular channel between a first position holding the vehicle liftgate in the open position and a second position holding the vehicle liftgate in the closed position, and a rectangular channel fixed to the vehicle at a rear pillar of the vehicle so that the linear upper portion is in a vertical orientation.

7. The power operating system as defined in claim 6 wherein the power unit is secured to an outboard side wall of the rectangular channel and comprises an electric motor that drives the output gear via an electromagnetic clutch.

8. The power operating system as defined in claim 6 wherein the first socket is open in a longitudinal direction of the vehicle and the second socket is open in a transverse direction of the vehicle.

9. The power operating system as defined in claim 6 wherein the rack bar has at least one shoe of low friction material at a leading end.

10. The power operating system as defined in claim 6 wherein the curved lower portion of the rectangular channel curves in a longitudinal direction of the vehicle.

11. A power operating system for opening and closing a vehicle liftgate that is pivotally attached to an aft end of a vehicle roof for pivotal movement between an open position and a closed position about a generally horizontal hinge axis comprising:

an annular channel having a linear upper portion and a curved lower portion, the linear upper portion having a longitudinal slot in a side wall of the annular channel and a window in the side wall of the annular channel disposed opposite the longitudinal slot, a flexible member disposed in the channel for movement in the channel, the flexible drive member comprising a plurality of links that are pivotally connected end to end to form a chain, one of the plurality of links having a stud that extends through the longitudinal slot in the side wall of the annular channel, a transfer link having an end that is universally connected to the stud, the transfer link having an opposite end that is universally attached to the liftgate at a location spaced from the hinge axis, and a power unit having an output member engaging the plurality of links in succession via the window for moving the flexible drive member in the annular channel between a first position holding the liftgate in the open position and a second position holding the vehicle liftgate in the closed position.

12. The power operating system as defined in claim 11 wherein the power unit is secured to the annular channel and comprises an electric motor that drives the output member via an electromagnetic clutch.

13. The power operating system as defined in claim 11 wherein the linear upper portion of the annular channel is disposed in the vehicle in a vertical orientation.

14. The power operating system as defined in claim 11 wherein the annular channel has a side wall that faces inboard and the longitudinal slot is in the side wall of the annular channel that faces inboard.

* * * * *